United States Patent [19]

Demny

[11] 4,306,440

[45] Dec. 22, 1981

[54] METHODS AND APPARATUS FOR ROLLING BARS, RODS AND WIRE

[75] Inventor: Werner Demny, Düsseldorf, Fed. Rep. of Germany

[73] Assignee: Friedrich Kocks GmbH & Co., Düsseldorf, Fed. Rep. of Germany

[21] Appl. No.: 121,377

[22] Filed: Feb. 14, 1980

[30] Foreign Application Priority Data

Mar. 3, 1979 [DE] Fed. Rep. of Germany ..... 2908409

[51] Int. Cl.[3] ..... B21B 1/18

[52] U.S. Cl. ..... 72/205; 72/234

[58] Field of Search ..... 72/205, 234, 366, 199, 72/250, 203, 249

[56] References Cited

U.S. PATENT DOCUMENTS 3,645,121 2/1972 Pfeiffer ..... 72/205

3,919,872 11/1975 Demny et al. ..... 72/205

FOREIGN PATENT DOCUMENTS 1293277 4/1962 France ..... 72/234

260578 1/1970 U.S.S.R. ..... 72/234

*Primary Examiner*—Milton S. Mehr

*Attorney, Agent, or Firm*—Buell, Blenko, Ziesenheim & Beck

[57] ABSTRACT

A method and apparatus are provided for the rolling of bars, rods or wire to avoid thickened ends in which a number of rolling stands are provided in tandem forming a rolling line and in which one or more of the last rolling stands in the line have separate drive means with means to regulate the speed independent of the other rolling stands to provide momentarily increased speed and tension on the two ends of the material being rolled.

13 Claims, 1 Drawing Figure

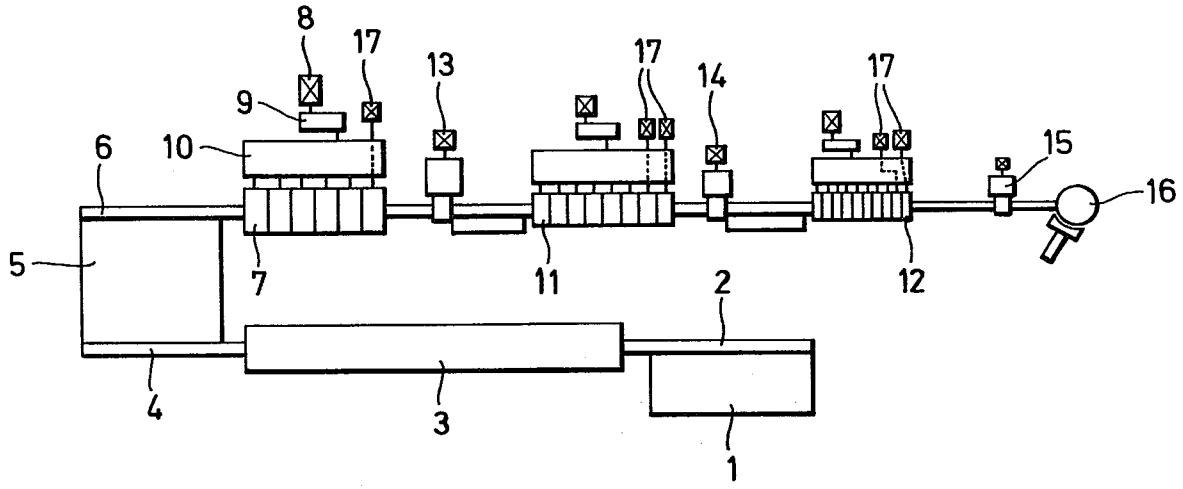
16
15
17
12
14
17
11
13
17
8
9
10
7
6
5
4
3
2
1

METHODS AND APPARATUS FOR ROLLING BARS, RODS AND WIRE

This invention relates to methods and apparatus for rolling bars, rods and wire. More specifically the invention relates to a rolling method and line for the rolling of bars, rods or wire, in which the rolling line, a number of rolling stands arranged in tandem is in each case combined to form one or a plurality of rolling blocks whose last rolling stands at the delivery end, or possibly the next to last rolling stands at the delivery end, have a separate drive with speed regulation which is independent of the other rolling stands.

When rolling with a rolling line of this kind, the rotational speed of the rolls of the individual stands in the various rolling blocks are chosen such that an appreciable tensile force is always exerted upon the work-material within the rolling blocks between the rollings stands. The reason for this is to ensure that the work-material runs through all the stands of the rolling line in a satisfactory and stable manner, and to prevent sticking or jamming of the work-material. This is also intended to prevent the work-material from forming loops at undesirable locations or veering off in a radial direction. Although the exertion of tension substantially avoids these disadvantageous phenomena, it gives rise to other disadvantages.

When rolling bars or wire under the action of tension in a longitudinal direction, extensive longitudinal portions having a larger cross-sectional area than the central longitudinal portion of the wire or bar are formed at the leading and trailing ends of a roll bar or wire. Longitudinal web-like ribs or fins are frequently formed by material which has been squeezed into the gaps between the rolls of a rolling stand. The two end portions having the larger cross-sectional area have to be cropped off, since they exceed the admissible tolerances and because they have undesirable cross-sectional shapes. The cropped end portions can only be used as scrap.

These end portions, called "thickened ends", are produced as a result of the method used for rolling the wire or bars. They are formed by virtue of the fact that, for example, the leading end portion is subjected to tension in a delayed manner and for a shorter period of time upon entry, namely only when its leading end enters the second rolling stand. In contrast to this, the following longitudinal portions of the bar or wire are subjected to tension immediately after they have entered the first rolling stand, since the leading end portion has already been engaged by at least the second sizing pass. The same thing happens to the trailing end portion upon delivery from the rolling mill, this trailing end portion always being relieved of tension when it has just left a sizing pass. Consequently, the leading and trailing end portions of each bar or wire length are not subjected to tension in the same manner as the central longitudinal portions, so that in ordinary practice the thickened ends are unavoidably produced.

The thickened ends which have already been produced in the first rolling block of the rolling line are still relatively short, but, owing to the considerable elongation of the work-material, their length is increased to several meters beyond the last rolling block, thus resulting in a considerable economic loss when they are cropped. The loss of material is not avoided even when the thickened ends are cropped beyond the first or second rolling block, since the cross sections at this location are larger. Furthermore, new thickened ends are also produced in the last rolling block for the same reasons and again have to be cropped.

An object of the invention is to provide a rolling line for the rolling of bars or wire, in which the thickened ends are kept as short as possible.

The present invention resides in a method of operating a rolling line for the rolling of bars, rods or wire, in which rolling line a number of rolling stands are arranged in tandem and are combined to form at least one rolling block of which at least the last rolling stand at its delivery end has a separate drive with speed regulation which is independent of the other rolling stands, and in which method, during the running through of the leading and trailing end portions of the bars, rods or wires through the last rolling stand of a block, the rolls of the said last rolling stand are driven momentarily at a higher rotational speed difference than their normal operating rotational speed difference relative to the stands arranged in advance thereof during rolling of the central longitudinal portions of the bars, rods or wires.

Thus, whenever the leading or trailing end portion of a bar or wire length has passed through the last rolling stand or, if need be, the next to last and last rolling stands, a specific amount of tension is exerted on this leading or trailing end portion, with the result that the larger cross section at his location is reduced. Thus, the method of the invention is used to exert a specific increased tension upon the leading and trailing end portions of the work-material between the rolling stands at the delivery or discharge end of the line. This tension substantially shortens the length of the thickened ends and may even substantially entirely eliminate it in the case of the leading end portion of the bars or wire lengths. It is impossible entirely to eliminate the thickened end at the trailing end portions, since, in order to exert tension, the work-material has to be engaged by at least two sizing passes, this no longer being possible when the end of the bar or wire length has left the last but one sizing pass. It is then no longer possible to allow the tension, increased in accordance with the invention, to become effective. A thickened end then remains whose length corresponds approximately to the distance between the last rolling stand and the next to last rolling stand. However, even this is a considerable improvement on the previously known solutions in which the thickened ends are several times longer.

In an advantageous embodiment of the invention, the percentage increase in the rotational speed difference in each case corresponds approximately to the percentage increase in the cross section of the end portion, otherwise produced without a change in the rotational speed of the last rolling stand or stands, compared with the central longitudinal portion of the bar or wire. Such dimensioning of the rotational speed difference virtually completely eliminates the leading thickened ends of the bars or wire lengths and shortens the length of the trailing thickened portions of the bars or wire lengths to a minimum.

In a rolling-line in which, during the running through of the end portions, the last and last but one rolling stands are driven at a higher rotational speed difference than the stands arranged upstream thereof, it is advisable, when rolling the leading and trailing end portions of the material, also to dimension the rotational speed difference between the last and last but one rolling stands so as to be greater than when rolling the central longitudinal portions of the material. In this manner, the tension between the last but one and the last rolling stand is increased, this being of importance particularly when the leading and trailing end portions are located in the region between the last and last but one rolling stands.

In general, after the trailing end portion of a bar, rod or wire length has run through, it is advantageous in the first instance to adjust the increased rotational speed difference only to the smaller increased rotational speed difference for the running-through of the leading end portion of the following bar or wire length, and thereafter to adjust the speed difference to the normal operation rotational speed difference. This avoids unnecessary changing of the rotational speeds of the last or last but one rolling stands, which would cost additional energy and time. In general, when special rotational speed regulation in accordance with the invention is not undertaken to avoid the leading thickened end portion, the latter is substantially smaller than the trailing thickened end portion produced at the same rotational speeds. Thus, the cross-sectional area of the leading thickened end portion can be, for example, 5% larger than that of the central longitudinal portion, and the cross-sectional area of the trailing thickened end portion of the same bar or wire length can be 10% larger than that of the central longitudinal portion. Consequently, with the invention, during the running through of the leading end portion, the rotational speed difference of the last, and, if need be, also of the last but one rolling stand, has to be increased by, say, 5% relative to that of the stand disposed upstream, and has to be increased, say, by 10% during the running through of the trailing end portion. When a trailing end portion has run through, it is followed by the leading end portion of a following bar, so that the rotational speed difference then only has to be varied by 5% and not by 10% up to the normal operating rotational speed difference.

Even though the effect in accordance with the invention can be obtained by varying the rotational speed differences, it can be further entrained by making the rolls of the last but one rolling stand adjustable in a radial direction to reduce the sizing pass during running-through of the leading and trailing end portions of the bars or wire lengths. This usually cannot be effected at the last rolling stand, since the latter is a finishing sizing pass in which a specific cross-sectional area has to be observed. If this is not the case, such as in the case of roughing or intermediate blocks, the last rolling stand can also be adjustable. As a rule, the advantageous action of the changed rotational speeds can be enhanced by additional adjustment of the rolls only at relatively low rolling speeds such as occur, for example, at roughing and intermediate blocks, since, otherwise, it would probably be difficult to adjust the roll with sufficient rapidity.

The invention is further described, by way of example, with reference to the accompanying diagrammatic drawing which illustrates a rolling line which is able to minimise the length of the thickened end portions, or which is able to avoid them.

Referring to the drawing billets coming from a storage place are unstacked at 1 and fed to a roller bed 2 which conveys the billets into a continuous-heating furnace 3. The billets leave the continuous-heating furnace 3 by way of a roller bed 4 from which they are conducted by means of a transfer skid 5 to a further roller bed 6 which is located in line with the rolling line of the actual rolling mill.

A six-stand roughing block 7 is driven by a motor 8 by way of a reduction gear 9 and a distribution gear 10 and is charged with the work-material from the roller bed 6. However, the last rolling stand of the roughing block 7 is driven by a separate motor 17, so that the rotational speeds of its rolls can be varied independently of the other roller stands.

An eight-stand intermediate block 11 is arranged in line with the roughing block 7, and a ten-stand finishing block 12 follows the intermediate block 11. The last and the last but one roll stands of the intermediate block 11 and of the finishing block 12 are driven by separate drive motors 17. Rotary shears 13 and 14 are provided between the blocks 7, 11 and 12 and primarily act as emergency shears in the event of a fault. A driver 15 and a pouring reeler 16 ensure that the finished-rolled wire is conveyed away in a satisfactory manner.

During entry of a leading end portion of a bar, rod or wire into the rolling line, the motors 17 run at a higher speed than normal to exert a higher than normal tension in the leading end piston and the speeds of the motors 17 are reduced to their normal operating speeds immediately after the leading end portion has left the respective stand. As the trailing end portion reaches the last stand, or the next to last stand in the case of the blocks 11 and 12, the speed of the respective motor 17 is increased to exert a higher than normal tension on the trailing end portion. The higher than normal tension exerted on the end portions further elongates these end portions to reduce the lengths of the thickened ends or to avoid thickened ends altogether.

In the foregoing specification certain preferred practices and embodiments of this invention have been set out, however, it will be understood that this invention may be otherwise embodied within the scope of the following claims.

I claim:

1. In a method of operating a rolling line for the rolling of bars, rods or wire, in which rolling line a number or rolling stands are arranged in tandem and are combined to form at least one rolling block of which at least the last rolling stand at its delivery end has a separate drive with speed regulation which is independent of the other rolling stands, the improvement comprising the step of momentarily driving the rolls of the said last rolling stand at a higher rotational speed difference than their normal operating speed difference relative to the stands arranged in advance thereof during the running through of the leading and trailing end portions of the bars, rods and wires through the said last rolling stand whereby increased tension is applied to said leading and trailing ends between said last rolling stand and the stand preceding it to reduce said leading and trailing ends are reduced in cross section to a greater degree than the central longitudinal portion of said bars, rods or wires between said last stand and the preceding stand.

2. A method of operating a rolling line as claimed in claim 1, in which the percentage increase in the rotational speed difference corresponds approximately to the percentage increase in the cross section of the end portions, otherwise produced without a change in the rotational speed of the last rolling stand or stands, compared with the central longitudinal portion of the rod or wire.

3. A method of operating a rolling line as claimed in claim 1 or 2, in which, during the running-through of the end portions, the last and next to last rolling stands of at least one of the blocks are driven at a higher rotational speed difference relative to the stands arranged in advance thereof.

4. A method of operating a rolling line as claimed in claim 3, in which the rotational speed differences between the last and next to last rolling stands when rolling the leading and trailing end portions of the material are greater than when rolling the central longitudinal portion of the material.

5. A method of operating a rolling line as claimed in claim 1 or 2, in which the increased rotational speed difference after the running-through of the trailing end portion of a bar, rod or wire is in the first instance adjusted only to the smaller increased rotational speed difference for the running-through of the leading end portion of the following bar or wire end and is only thereafter adjusted to the normal operating rotational speed difference.

6. A method of operating a rolling line as claimed in claim 3, in which the increased rotational speed difference after the running-through of the trailing end portion of a bar, rod or wire is in the first instance adjusted only to the smaller increased rotational speed difference for the running-through of the leading end portion of the following bar or wire and is only thereafter adjusted to the normal operating rotational speed difference.

7. A method of operating a rolling mill as claimed in claim 4, in which the increased rotational speed difference after the running-through of the trailing end portion of a bar, rod or wire is in the first instance adjusted only to the smaller increased rotational speed difference for the running-through of the leading end portion of the following bar or wire and is only thereafter adjusted to the normal operating rotational speed difference.

8. A method of operating a rolling line as claimed in claims 1 or 2, in which the rolls of the next to last rolling stand of a block are adjustable in a radial direction to reduce the sizing pass, and in which such rolls are radially adjusted during the running-through of the leading and trailing end portions of the bars, rolls or wires.

9. A method of operating a rolling line as claimed in claim 3, in which the rolls of the next to last rolling stand of a block are adjustable in a radial direction to reduce the sizing pass, and in which such rolls are radially adjusted during the running-through of the leading and trailing end portions of the bars, rolls or wires.

10. A method of operating a rolling mill line as claimed in claim 4, in which the rolls of the next to last rolling stand of a block are adjustable in a radial direction to reduce the sizing pass, and in which such rolls are radially adjusted during the running-through of the leading and trailing end portions of the bars, rolls or wires.

11. A method of operating a rolling mill line as claimed in claim 5, in which the rolls of the next to last rolling stand of a block are adjustable in a radial direction to reduce the sizing pass, and in which such rolls are radially adjusted during the running-through of the leading and trailing end portions of the bars, rolls or wires.

12. A method of operating a rolling mill line as claimed in claim 6 in which the rolls of the next to last rolling stand of a block are adjustable in a radial direction to reduce the sizing pass, and in which such rolls are radially adjusted during the running-through of the leading and trailing end portions of the bars, rolls or wires.

13. A method of operating a rolling mill as claimed in claim 7 in which the rolls of the next to last rolling stand of a block are adjustable in a radial direction to reduce the sizing pass, and in which such rolls are radially adjusted during the running-through of the leading and trailing end portions of the bars, rolls or wires.

* * * * *